US007018310B2

(12) United States Patent
Sato et al.

(10) Patent No.: US 7,018,310 B2
(45) Date of Patent: Mar. 28, 2006

(54) GOLF BALL

(75) Inventors: Katsunori Sato, Chichibu (JP); Atsuki Kasashima, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/884,977

(22) Filed: Jul. 7, 2004

(65) Prior Publication Data

US 2005/0009643 A1 Jan. 13, 2005

(30) Foreign Application Priority Data

Jul. 7, 2003 (JP) ..... 2003-192749

(51) Int. Cl.
*A63B 37/14* (2006.01)

(52) U.S. Cl. ..... 473/384

(58) Field of Classification Search ..... 473/378–385
See application file for complete search history.

(56) References Cited

U.S. PATENT DOCUMENTS

| | | | | |
|---|---|---|---|---|
| D355,943 | S * | 2/1995 | Cadorniga | D21/205 |
| 5,470,076 | A * | 11/1995 | Cadorniga | 473/384 |
| 5,566,943 | A * | 10/1996 | Boehm | 473/378 |
| 6,010,442 | A * | 1/2000 | Lemons et al. | 473/384 |
| 6,346,054 | B1 | 2/2002 | Shimosaka et al. | |
| 6,368,238 | B1 * | 4/2002 | Kasashima et al. | 473/383 |
| 6,569,038 | B1 * | 5/2003 | Sullivan | 473/383 |
| 6,709,349 | B1 * | 3/2004 | Sullivan | 473/383 |

FOREIGN PATENT DOCUMENTS

JP 2000-70413 A 3/2000

* cited by examiner

*Primary Examiner*—Raeann Gorden
(74) *Attorney, Agent, or Firm*—Sughrue Mion, PLLC

(57) ABSTRACT

In a golf ball possessing a spherical surface having a first radius from a ball center, the spherical surface includes a plurality of small spherical regions having a second radius from the center which is smaller than the first radius. The golf ball is improved in flight performance owing to the reduced air resistance.

13 Claims, 9 Drawing Sheets

GOLF BALL

TECHNICAL FIELD

This invention relates to a golf ball having improved flight performance.

BACKGROUND ART

It is well known in the golf ball art that numerous dimples are formed on the surface of a golf ball for improving the aerodynamic properties of the golf ball over a golf ball having a dimple-free smooth spherical surface. The provision of dimples is effective for improving the flight performance.

In general, the shape of dimples as viewed from above or in plane is circular. It is also known that the percentage of dimple areas relative to the golf ball surface, referred to as percent dimple area, contributes to flight performance. The higher the percent dimple area, the better become the aerodynamic properties. Accordingly, the use of circular dimples having the same diameter is surpassed by the combined use of dimples of plural types having different diameters. Efforts were made to increase the population of dimples arranged. As a result, not only the circular shape, but also an elliptic shape, a teardrop shape and polygonal shapes such as a hexagonal shape are now available for the shape of dimples as viewed from above.

With respect to the arrangement of dimples, efforts were made to arrange dimples over the spherical surface as evenly as possible. Several spherical polyhedral patterns such as spherical icosahedral, dodecahedral and octahedral patterns have been proposed, as described in JP-A 2000-70413, for example.

However, as long as the arrangement or array of dimples is concerned, a certain limit is imposed on the effect of dimple arrangement independent of how dimples of whatever shape or type are combined. There exists a need for an approach toward an improvement in flight performance of a golf ball based on a concept different from the traditional dimple arrangement.

SUMMARY OF THE INVENTION

An object of the invention is to provide a golf ball whose flight performance is improved by altering the spherical surface based on a concept completely different from the traditional dimple arrangement.

Addressing a golf ball possessing the spherical surface of a major sphere, the inventor has found that the golf ball is improved in flight performance when a plurality of small spherical regions or recesses, whose bottom is a part of the spherical surface of a subordinate sphere concentric with the major sphere and having a slightly smaller radius than the major sphere, are dispersedly located on the spherical surface of the major sphere.

The present invention provides a golf ball possessing a spherical surface having a first radius from a ball center, wherein the spherical surface includes a plurality of small spherical regions having a second radius from the center which is smaller than the first radius.

In one preferred embodiment, at least one depression, typically a plurality of depressions are formed in each small spherical region. The total area of the small spherical regions is preferably at least 30% of the entire spherical surface. The difference between the first radius and the second radius is preferably in a range of 0.01 to 0.2 mm. Preferably the shape of the small spherical region is substantially circular as viewed from above. Most often, a plurality of dimples are formed on the spherical surface excluding the small spherical regions.

DESCRIPTION OF THE PREFERRED EMBODIMENTS

The golf ball of the invention possessing a spherical surface having a first radius from a ball center is characterized in that the spherical surface includes a plurality of small spherical regions or recesses having a second radius from the center which is smaller than the first radius. The small spherical regions or recesses are concentric with the spherical surface, as is evident from the relationship of center, radius and spherical surface.

In the prior art, when dimples are formed on the spherical surface of a golf ball, the percent dimple area relative to the spherical surface and the dimple arrangement are devised so as to improve the aerodynamic properties of the golf ball. In contrast, the present invention relies on the new concept that a plurality of small spherical regions concentric with the spherical surface and having a smaller radius are provided in the spherical surface and preferably, at least one depression is formed in each small spherical region. Based on this concept which is essentially unexpected from the prior art approaches, the present invention improves the aerodynamic properties of the golf ball.

Figure 1:
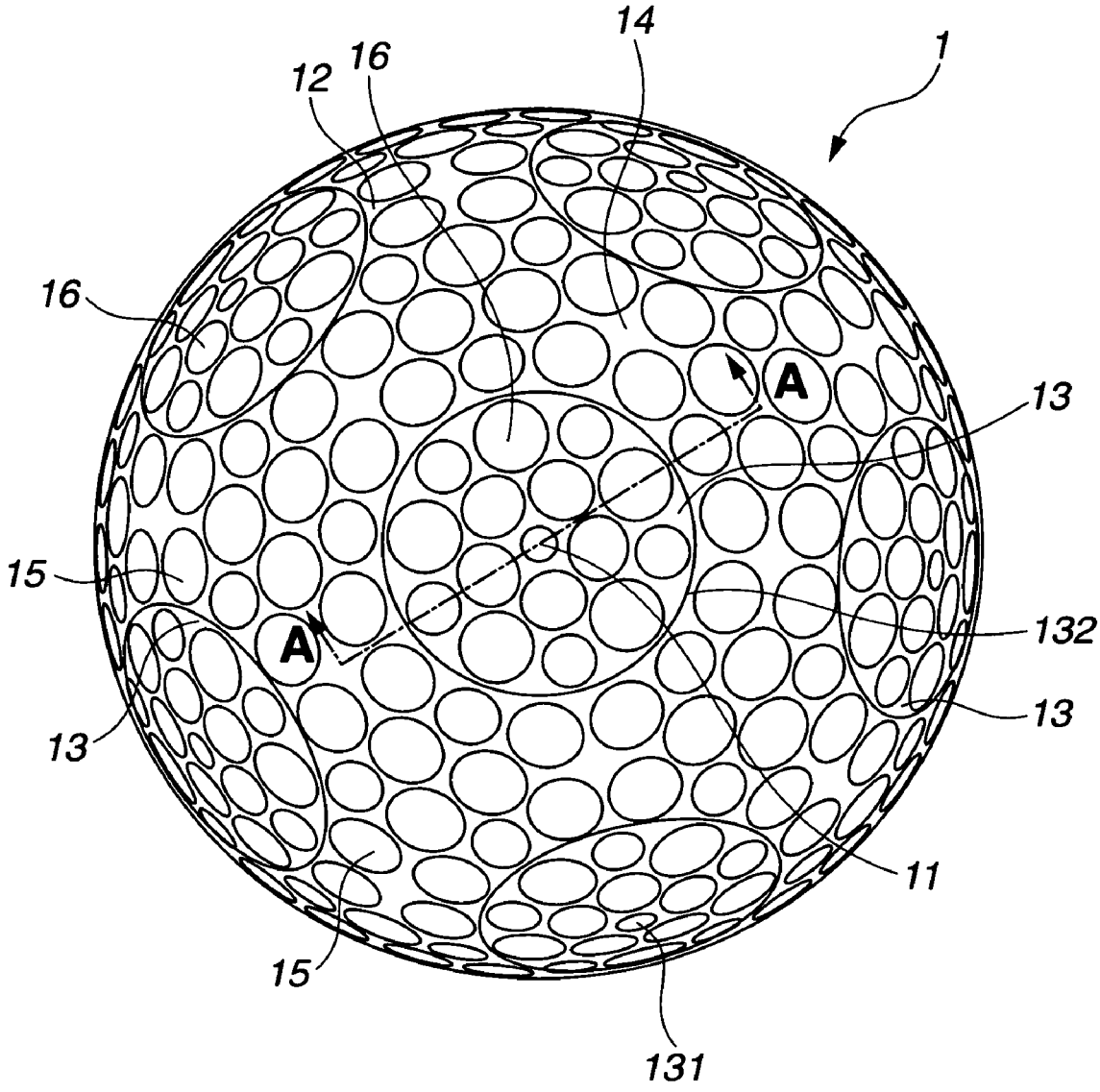
FIGS. 1 and 2 are plan views as viewed from above the pole and the equator of a golf ball in one embodiment of the invention, respectively.
Figure 2:
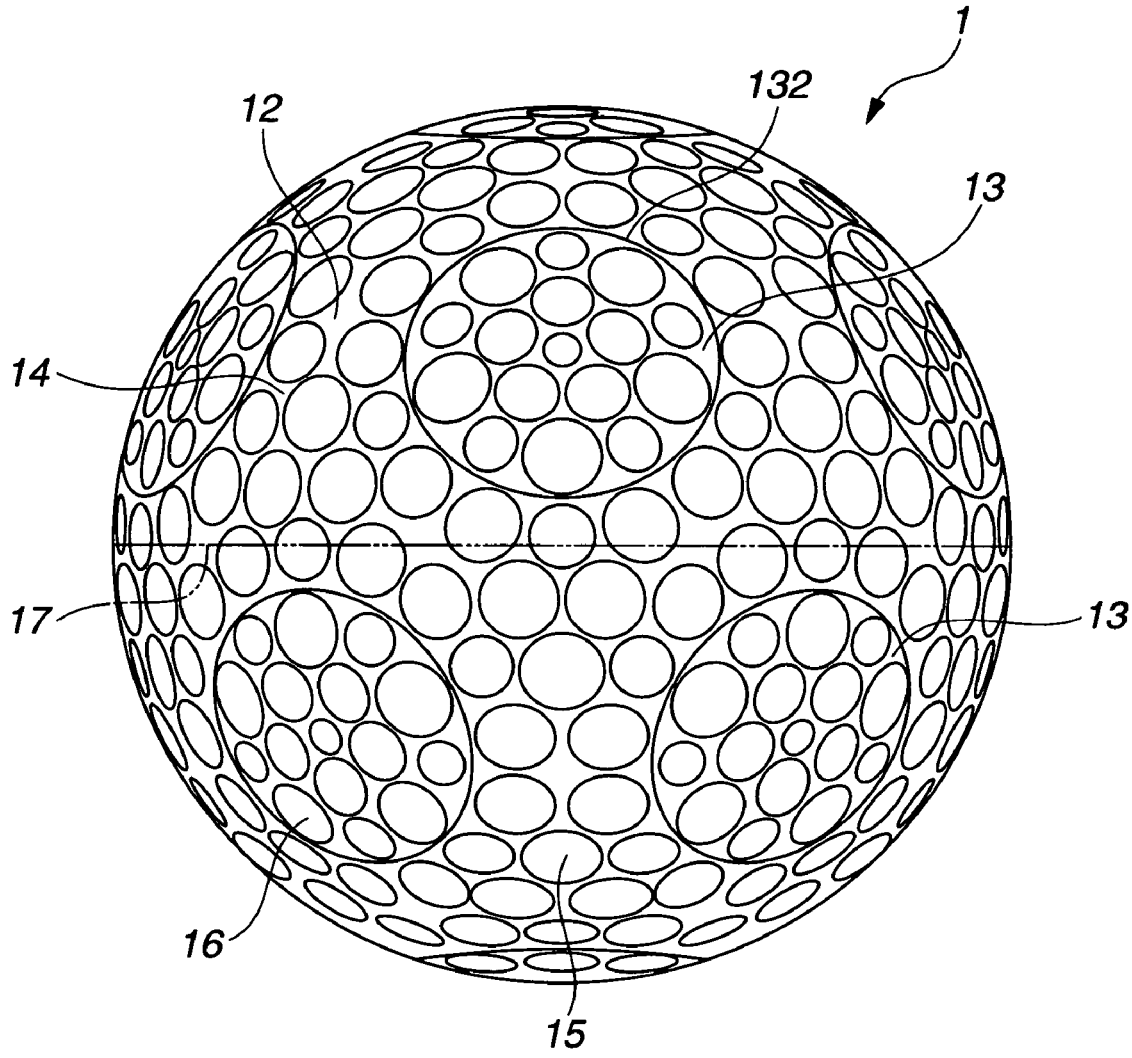
Figure 3:
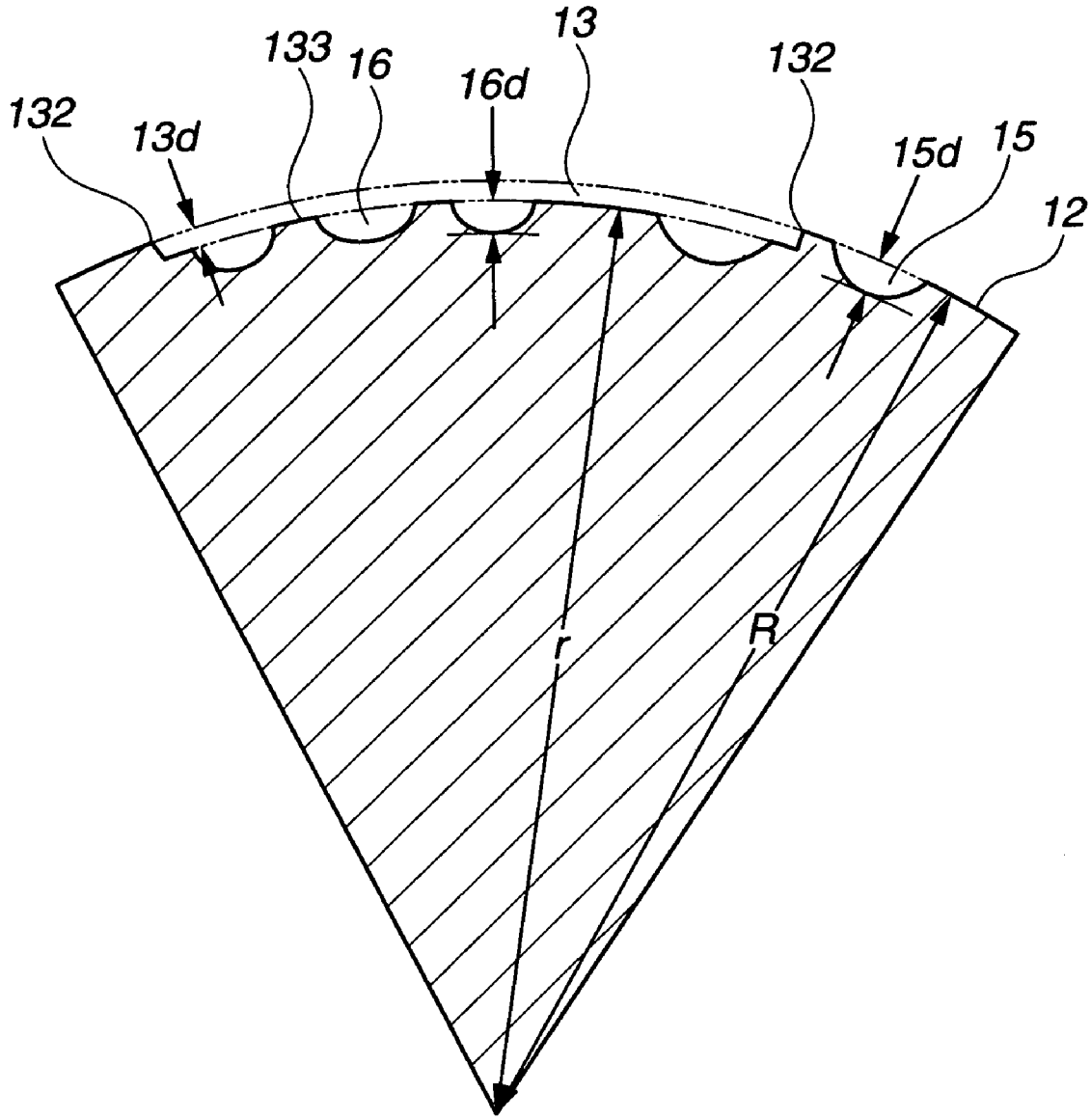
FIG. 3 is a cross-sectional view of the golf ball taken along lines A—A in FIG. 1, showing a small spherical region.

FIG. 1 is a plan view as viewed from above the pole of a golf ball 1 in one embodiment of the invention; FIG. 2 is a plan view as viewed from above the equator of the golf ball 1; and FIG. 3 is a cross-sectional view taken along lines A—A in FIG. 1. The golf ball has a pair of poles, one depicted at 11, and an equator 17.

The golf ball 1 possesses a spherical surface 12 which includes a plurality of small spherical regions or recesses 13 of a circular shape as viewed from above or in plane. A plurality of dimples 15 are formed on the spherical surface 12 excluding the small spherical regions 13. A plurality of depressions 16 are arranged in good balance on the subordinate spherical surface within each small spherical region 13.

Figure 4:
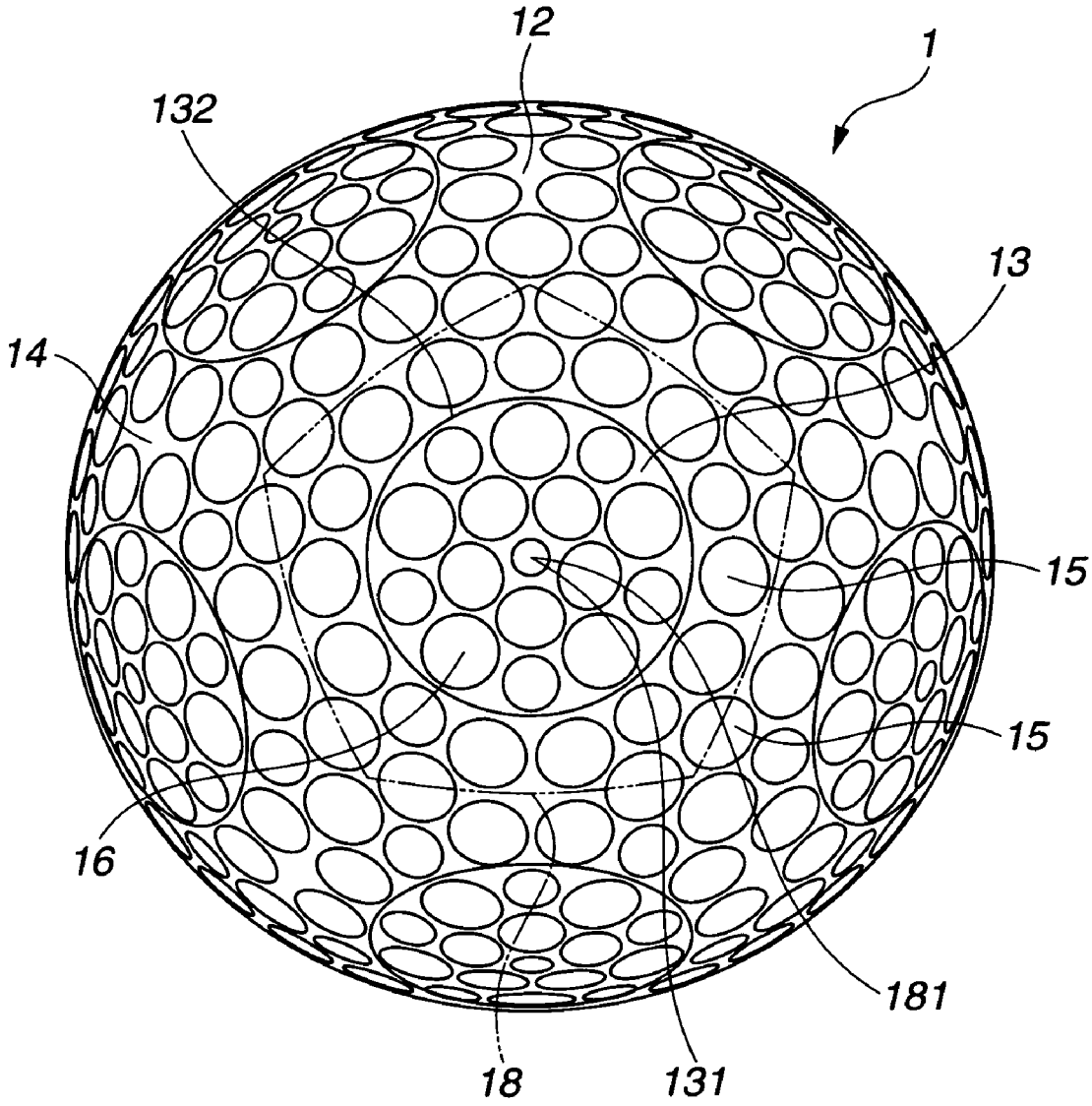
FIG. 4 is a plan view similar to FIG. 1 of the golf ball in the one embodiment, illustrating the arrangement of small spherical regions, dimples and depressions.

In the illustrated golf ball 1, twelve small spherical regions 13 are arranged on the spherical surface in accordance with the spherical dodecahedral pattern. The spherical polyhedral pattern which can be employed herein is not limited thereto. Using any spherical polyhedral pattern such as the spherical icosahedral or octahedral pattern, small spherical regions 13 can be arranged on the spherical surface of the golf ball in good balance. While the spherical dodecahedral pattern employed for the golf ball 1 is constituted by twelve pentagonal units, only one pentagonal unit is depicted in FIG. 4 at 18 by dot-and-dash lines.

No particular limit is imposed on the size of the small spherical regions and the polygonal units constituting the spherical polyhedral pattern. In the golf ball 1, the small spherical regions 13 and the pentagonal units 18 are disposed such that the barycenter 181 of the pentagonal unit is coincident with the center 131 of the small spherical region and the small spherical region 13 is contained within the pentagonal unit 18. Moreover, the small spherical region 13 is formed relatively small so that the boundary 132 of the small spherical region 13 is spaced apart from the equator 17 of the golf ball 1, as shown in FIG. 2. The dimensional relationship between small spherical regions and pentagonal units and the positional relationship between the equator and small spherical regions in the illustrated embodiment are preferred from the standpoint of conferring the golf ball with better aerodynamic properties.

In the illustrated golf ball 1, the small spherical region has a shape which is circular as viewed from above. The shape as viewed from above of small spherical regions is not limited thereto. Any of circular, elliptic, and polygonal (preferably regular polygonal) shapes including triangular, quadrangular, pentagonal and hexagonal shapes may be used. From the standpoints of the efficient manufacture of a golf ball mold and the aesthetic appearance of a golf ball for the intended application, it is preferred that the small spherical region have a circular shape as viewed from above.

From the standpoint of establishing a significant improvement in flight performance over conventional golf balls having dimples formed solely on its spherical surface, the total area of small spherical regions is preferably at least 30%, more preferably at least 35% of the entire spherical surface, that is, the area of the spherical surface of an imaginary sphere which is absent from small spherical regions. No particular upper limit need be imposed on the total area of small spherical regions as long as the flight performance is concerned, but the total area of small spherical regions is preferably up to 95%, more preferably up to 85% of the entire spherical surface, in view of the standard value prescribing the ball diameter.

When the depressions 16 are disposed within the small spherical region 13, it is not critical how to arrange the depressions. Particularly when a plurality of depressions 16 are disposed within one small spherical region 13, they should be arranged in good balance. In the illustrated golf ball 1, sixteen depressions 16 of four types having different diameters are disposed within the small spherical region 13. More specifically, a total number of sixteen depressions are disposed in good balance such that they include one depression in alignment with the center 131 of the small spherical region, two depressions on a radial line from the center 131 of the small spherical region to the mid-point of each side of the pentagonal unit 18, and one depression on a radial line from the center 131 of the small spherical region to each apex of the pentagonal unit 18.

In the practice of the invention, it is optional to form dimples on the spherical surface where no small spherical regions are formed. From the standpoint of obtaining better aerodynamic properties, it is preferred to arrange dimples in good balance on the spherical surface where no small spherical regions are formed. In the golf ball 1 illustrated in FIG. 4, dimples 15 of two types having different diameters are disposed in the zone between the boundary 132 of the small spherical region 13 and each side of the pentagonal unit 18, in a total number of fifteen and in good balance so as to surround the small spherical region 13. Additionally, two dimples 15 of one type are disposed on each side of the pentagonal unit 18 such that the center of each dimple 15 is aligned with the side of the pentagonal unit 18.

In the practice of the invention, the number of depressions formed in each small spherical region is suitably determined in accordance with the shape as viewed from above and size of the small spherical region, the shape as viewed from above and size of depressions formed therein, and other factors. The number of depressions formed in each small spherical region is typically in a range of 1 to 22, preferably 5 to 20.

The total number of dimples formed on the golf ball surface (the total number of dimples formed outside the small spherical regions) is typically in a range of 0 to 200, preferably 100 to 140.

In the invention, the shape as viewed in plane and the shape as viewed in cross section of dimples 15 formed outside the small spherical regions and depressions 16 formed within the small spherical regions 13 are not particularly limited. Preferably for both the dimples and depressions, the shape as viewed in plane is circular and the shape as viewed in cross section is concave arcuate or analogous.

FIG. 3 is a cross-sectional view taken along lines A—A in FIG. 1. It is seen that the spherical surface 12 of the golf ball 1 has a first radius R from a ball center and the small spherical region 13 has a second radius "r" from the center which is slightly smaller than the first radius R. Depressions 16 are formed within the small spherical region 13, and dimples 15 are formed outside the small spherical region 13, to a depth 16*d* and 15*d*, respectively, and to a substantially concave arcuate shape in cross section. In FIG. 3, the difference of the first radius R of the sphere defining the spherical surface 12 and the second radius "r" of a subordinate sphere defining the small spherical regions is, of course, equal to the depth 13d of the small spherical region 13.

The difference of the first radius R defining the spherical surface 12 and the second radius "r" defining the small spherical regions, that is (R-r) is typically at least 0.01 mm, preferably at least 0.02 mm, but typically up to 0.2 mm, preferably up to 0.15 mm. A radius difference of less than 0.01 mm may adversely affect the carry of the ball. A radius difference in excess of 0.2 mm results in a ball which geometrically deviates from a sphere and thus becomes awkward to roll.

In the practice of the invention, the depressions 16 formed with in the small spherical regions 13 and the dimples 15 formed outside the small spherical regions may differ in the shape as viewed in plane and/or the depth. Specifically, the depressions and dimples may be designed such that the depth 16*d* of the depressions 16 formed within the small spherical regions 13 is less than the depth 15*d* of the dimples 15 formed outside the small spherical regions. It is noted that the depth 16*d* is a radial distance from an extension (dot-and-dash line) of the small spherical surface 133 to the bottom of each depression 16, and the depth 15*d* is a radial distance from an extension (double dots-and-dash line) of the spherical surface 12 to the bottom of each dimple 15.

No particular limit is imposed on the depth of dimples 15 and depressions 16. The depth 15*d* of dimples is typically 0.08 to 0.2 mm. The depth 16*d* of depressions is typically at least 0.04 mm, preferably at least 0.07 mm, but typically up to 0.19 mm, preferably up to 0.15 mm.

In conjunction with the cross-sectional shape of small spherical regions, dimples and depressions, the cross-sectional shape of a portion extending across the boundary between the small spherical region and the spherical surface or a portion of transition from the subordinate spherical surface to the spherical surface, the partial cross-sectional shape of dimple edge, and the partial cross-sectional shape of depression edge are preferably inclined at a suitable angle or rounded. Such transitions allow a paint composition to be applied to the molded golf ball to a uniform coating thickness and additionally, improve the ink transfer when logo marks are printed on the paint coating.

The diameter, depth and number of depressions 16 formed within the small spherical regions may be determined by various methods while taking into account the three-dimensional shape (area and depth) of small spherical regions and the shape and number of dimples formed on the spherical surface. One typical approach for the determination of such parameters is described below.

In the golf ball 1 illustrated in FIGS. 3 and 4, a proportion Vr (%) of the sum of the total of volumes of dimples within the pentagonal unit plus the volume of small spherical region and the volumes of depressions relative to the volume of a pentagonal pyramid standing on a pentagonal unit 18 having a spherical surface with a radius R based on the assumption that the small spherical region 13, the depressions 16 and the dimples 15 are absent is preset to 0.78%, for example. Then, the shape (diameter and depth) of the small spherical region 13 formed within the pentagonal unit 18 and the diameter, depth and number of dimples 15 and depressions 16 formed inside and outside the small spherical region 13 are determined so as not to deviate substantially from the preset proportion Vr.

Figure 5:
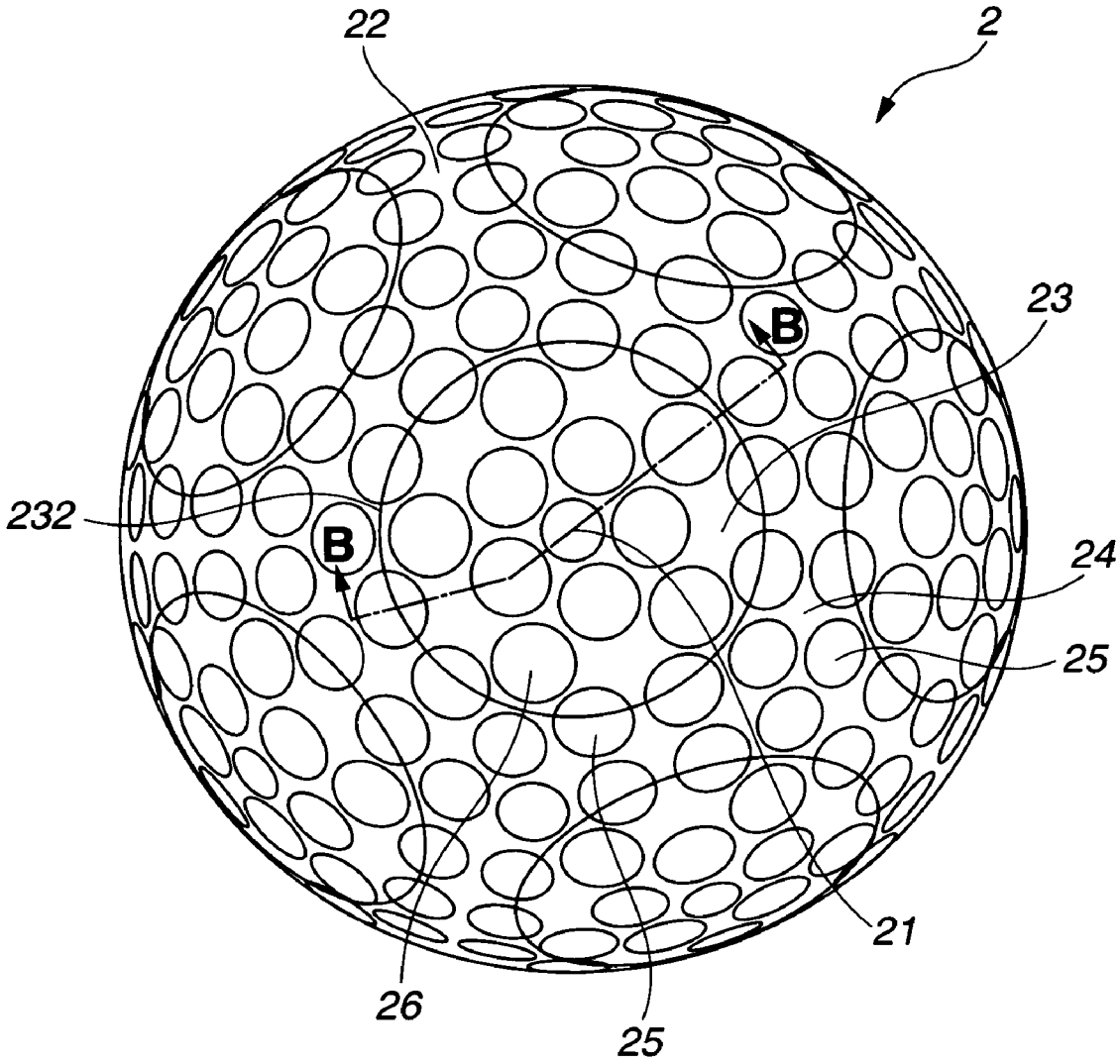
FIGS. 5 and 6 are plan views as viewed from above the pole and the equator of a golf ball in another embodiment of the invention, respectively.
Figure 6:
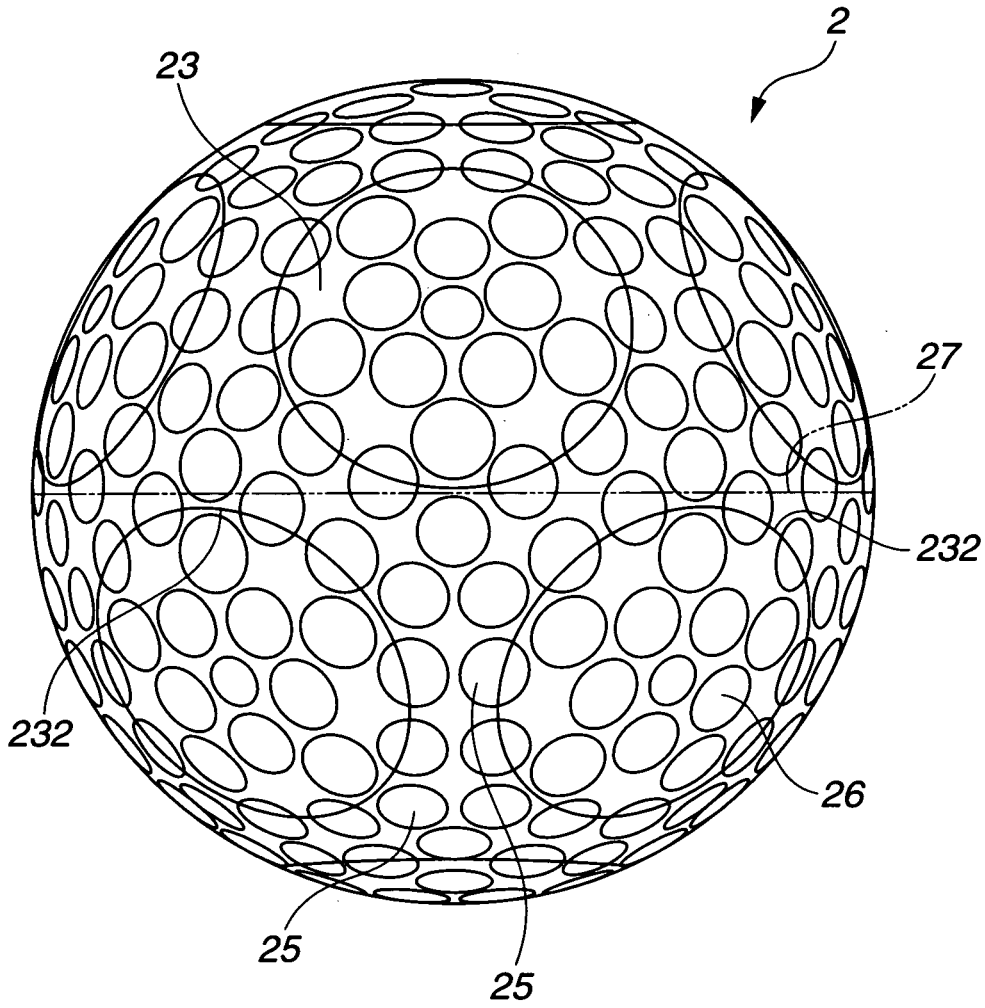
Figure 7:
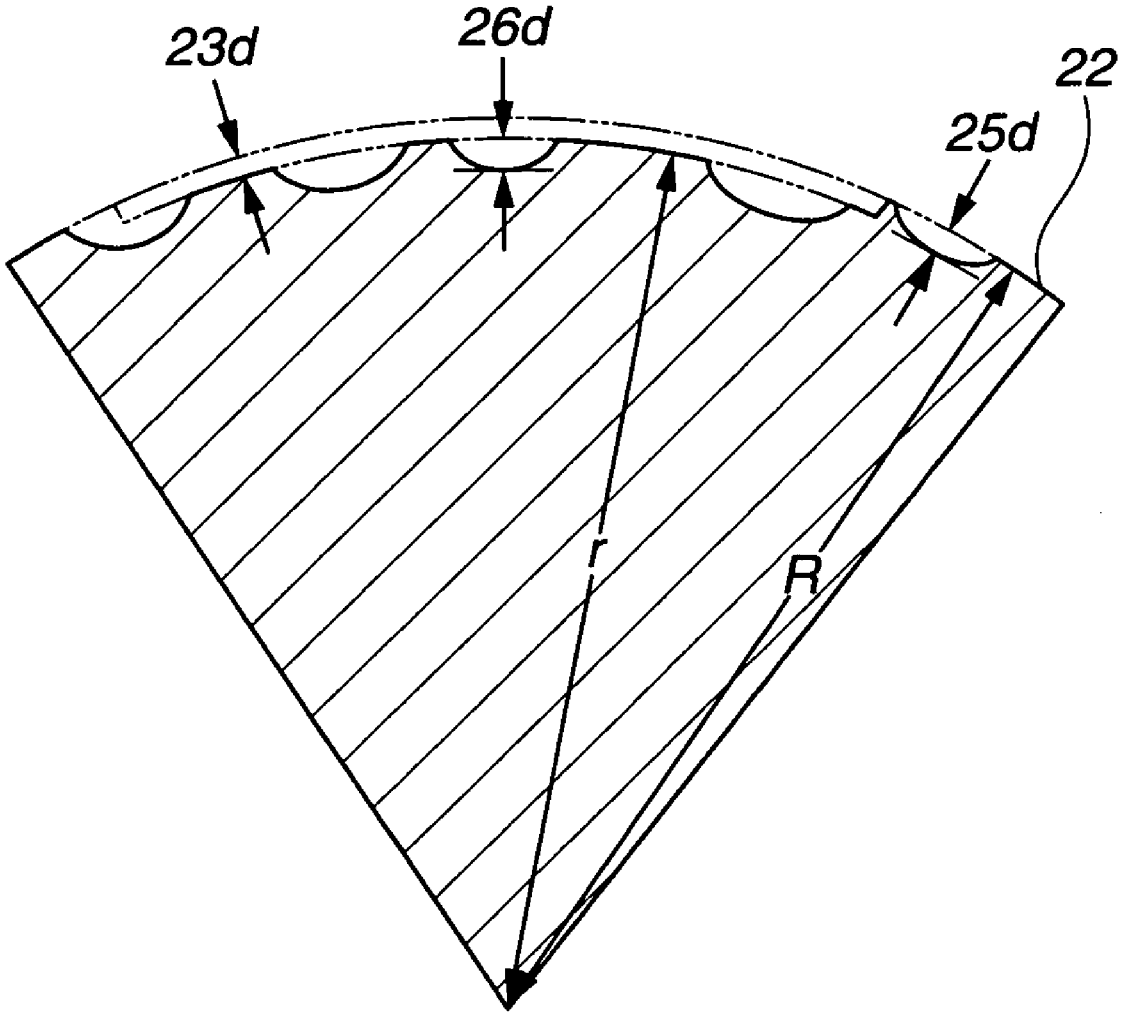
FIG. 7 is a cross-sectional view of the golf ball taken along lines B—B in FIG. 5, showing a small spherical region.

FIG. 5 is a plan view as viewed from above the pole of a golf ball 2 in another embodiment of the invention; FIG. 6 is a plan view as viewed from above the equator of the golf ball 2; and FIG. 7 is a cross-sectional view taken along lines B—B in FIG. 5. The golf ball has a pair of poles, one depicted at 21, and an equator 27.

In the illustrated golf ball 2, a plurality of small spherical regions or recesses 23 of a circular shape as viewed from above are formed on the spherical surface 22. Dimples 25 surrounded by lands 24 are formed on the spherical surface 22 where the small spherical regions 23 are not disposed. Depressions 26 are arranged within the small spherical regions 23 in good balance.

The golf ball 21 is the same as the golf ball 1 in that the small spherical regions 23 are arranged in accordance with the spherical dodecahedral pattern. The golf ball 2 is characterized in that the small spherical regions 23 have a relatively large diameter, and as a result, the boundaries 232 of all the small spherical regions 23 except for the small spherical regions 23 centered at the poles 21 extend close to the equator 27 of the golf ball 2, and ten dimples 25 which extend across the boundary 232 into the small spherical region 23 are formed on the boundary 232 of each small spherical region 23.

The golf ball of the invention can be manufactured by any of well-known methods, for example, injection molding. A golf ball-forming mold used is prepared by machining a reversal master model to three-dimensionally define the entire surface shape of a golf ball with the aid of 3D CAD/CAM, and forming an injection mold cavity with an inner wall shape which is a reverse of the surface shape in a conventional manner. Alternatively, the cavity of a golf ball-shaping mold is directly machined in three dimensions with the aid of 3D CAD/CAM.

EXAMPLE

Examples of the invention are given below by way of illustration and not by way of limitation.

Examples 1–2 and Comparative Example 1

Figure 8:
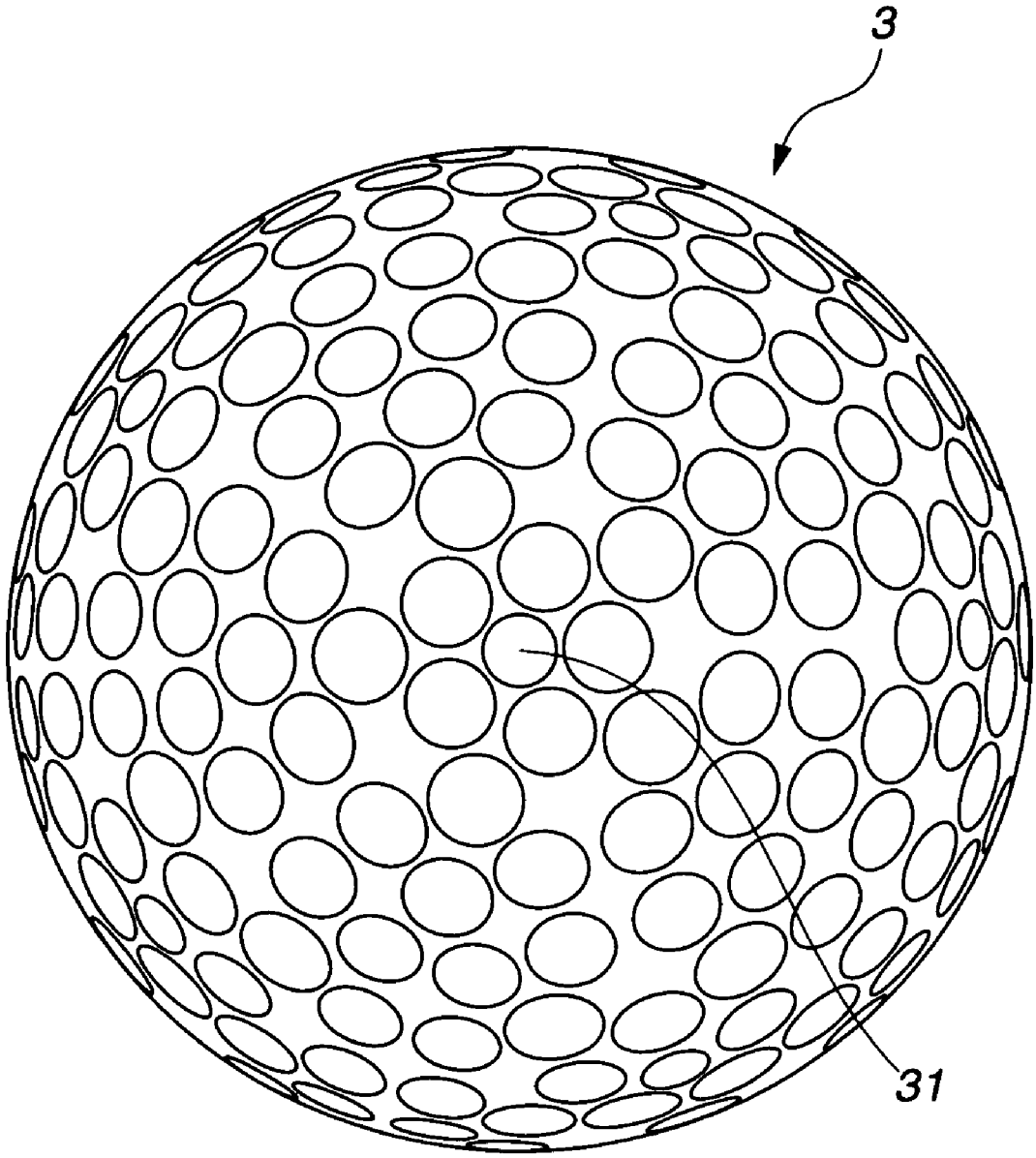
FIGS. 8 and 9 are plan views as viewed from above the pole and the equator of a prior art golf ball, respectively.
Figure 9:
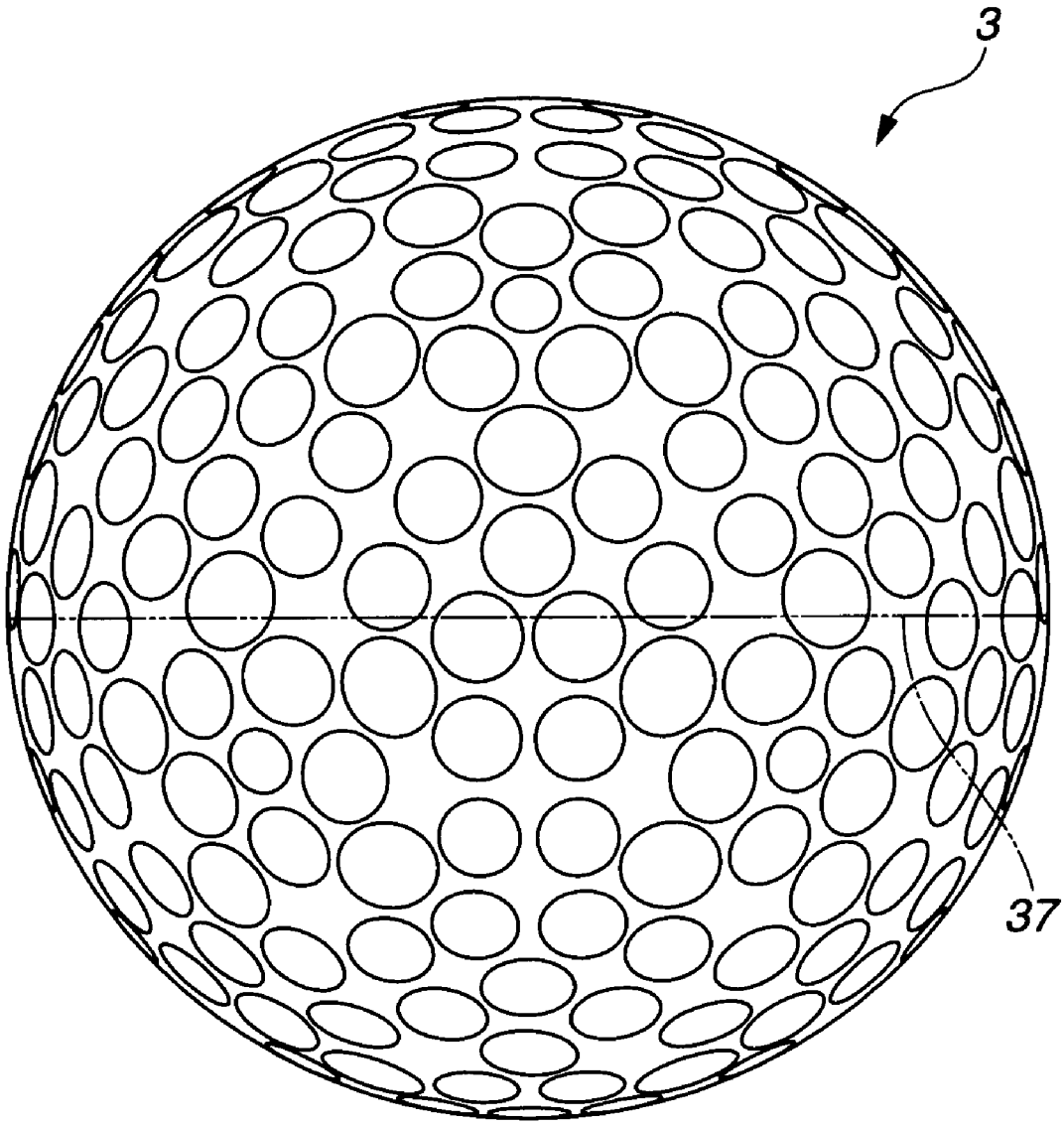

Examples 1 and 2 correspond to the golf balls 1 and 2 illustrated in FIGS. 1–3 and FIGS. 5–7, respectively. Comparative Example 1 is a golf ball 3 which is illustrated in FIGS. 8 and 9, which are plan views as viewed from above the pole and the equator, respectively. A hitting test was conducted on the balls of Examples 1 and 2 and Comparative Example 1, during which a carry and a total distance were measured.

The golf balls of Examples 1 and 2 and Comparative Example 1 are solid golf balls of a three-layer structure constructed of a monolithic core of rubber, an intermediate layer of a single layer enclosing the core, and a cover of a single layer enclosing the intermediate layer. The intermediate layer material used was a composition comprising an ionomer resin and an olefin elastomer. The cover stock used was a polyurethane elastomer.

Also in Examples 1 and 2 and Comparative Example 1, the intermediate layer had a gage of 1.65 mm and a Shore D hardness of 61 as measured on its outer surface, and the cover had a gage of 1.5 mm and a Shore D hardness of 58 as measured on the land of the ball spherical surface.

Table 1 reports the data relating to the dimples and small spherical regions formed on the golf ball surface, and the depressions formed within the small spherical regions. Table 2 shows the results of the hitting test on the golf balls.

TABLE 1

| Dimple arrangement pattern | | | Example 1 FIG. 1 | Example 2 FIG. 5 | Comparative Example 1 FIG. 8 |
|---|---|---|---|---|---|
| Dimples | 1 | Diameter (mm) | 4.0 | 3.8 | 4.3 |
| | | Number | 120 | 180 | 60 |
| | 2 | Diameter (mm) | 3.8 | — | 4.0 |
| | | Number | 60 | — | 60 |
| | 3 | Diameter (mm) | 3.2 | — | 3.8 |
| | | Number | 60 | — | 180 |
| | 4 | Diameter (mm) | — | — | 3.0 |
| | | Number | — | — | 12 |
| | | Total number | 240 | 180 | 312 |
| Small spherical regions | Diameter (mm) | | 15.0 | 18.5 | — |
| | Number | | 12 | 12 | — |
| | Area relative to spherical surface (%) | | 38 | 59 | — |
| Depressions | 1 | Diameter (mm) | 3.8 | 4.3 | — |
| | | Number | 60 | 60 | — |
| | 2 | Diameter (mm) | 3.2 | 4.0 | — |
| | | Number | 60 | 60 | — |
| | 3 | Diameter (mm) | 2.7 | 3.0 | — |
| | | Number | 60 | 12 | — |
| | 4 | Diameter (mm) | 2.0 | — | — |
| | | Number | 12 | — | — |
| | | Total number | 192 | 132 | 0 |
| Vr (%) | | | 0.78 | 0.78 | 0.78 |

Area Relative to Spherical Surface (%)

the total of the areas of small spherical regions relative to the surface area of an imaginary sphere having a smooth spherical surface, expressed in percent.

Vr (%)

the overall total of the volumes of dimples plus the volumes of small spherical regions plus the volumes of depressions (Examples) or the total of the volumes of dimples (Comparative Example) relative to the volume of an imaginary sphere having a smooth spherical surface, expressed in percent.

TABLE 2

| | Example | | Comparative Example |
|---|---|---|---|
| | 1 | 2 | 1 |
| Carry (m) | 215.4 | 218.5 | 213.1 |
| Total (m) | 230.2 | 233.1 | 228.5 |

Carry and Total

Using a hitting machine fitted with a driver (W#1), the ball was hit ten times at a head speed of 45 m/s and a launch angle of 10°. Each time a carry and a total distance were measured in meter, and an average of ten hits was computed.

As seen from the results of Table 2, Examples 1 and 2 are superior in both carry and total distance to Comparative Example 1.

There has been described a golf ball which is improved in flight performance owing to the reduced air resistance of the ball in flight.

Japanese Patent Application No. 2003-192749 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball possessing a spherical surface having a first radius R from a ball center, wherein the spherical surface includes a plurality of small spherical regions having a second radius r from the center which is smaller than the first radius and a plurality of depressions are formed in each said small spherical regions and a plurality of dimples are formed on said spherical surface outside said small spherical regions, wherein said depressions in the small spherical regions have a depth of 0.04 to 0.19 mm and said dimples on the spherical surface have a depth of 0.08 to 0.2 mm.

2. The golf ball of claim 1, wherein the total area of the small spherical regions is at least 30% of the entire spherical surface.

3. The golf ball of claim 1, wherein the difference between the first radius R and the second radius r is in a range of 0.01 to 0.2 mm.

4. The golf ball of claim 1, wherein the shape of the small spherical region is substantially circular as viewed from above.

5. The golf ball of claim 1, wherein said depth of the depressions is less than said depth of the dimples.

6. The golf ball of claim 1, wherein said small spherical regions are arranged on the spherical surface in accordance with the spherical dodecahedral, icosahedral or octahedral pattern.

7. The golf ball of claim 1, wherein twelve of said small spherical regions are arranged on the spherical surface in accordance with the spherical dodecahedral pattern.

8. The golf ball of claim 7, wherein said small spherical regions and pentagonal units constituting the dodecahedral pattern are disposed such that a barycenter of each pentagonal unit is coincident with a center of each small spherical region.

9. The golf ball of claim 7, wherein said small spherical regions are contained within pentagonal units.

10. The golf ball of claim 1, wherein, in each small spherical region, 5 to 20 depressions are formed.

11. The golf ball of claim 1, wherein said depressions have a circular shape in a plane view.

12. The golf ball of claim 1, wherein, on said spherical surface outside said small spherical regions, 100 to 140 dimples are formed.

13. A golf ball possessing a spherical surface having a first radius R from a ball center, wherein the spherical surface includes a plurality of small spherical regions having a second radius r from the center which is smaller than the first radius and a plurality of depressions are formed in each said small spherical regions and a plurality of dimples are formed on said spherical surface outside said small spherical regions, wherein the difference between said first radius R and said second radius r is from 0.02 to 0.15 mm.

* * * * *